US011326436B2

(12) United States Patent
Fry

(10) Patent No.: US 11,326,436 B2
(45) Date of Patent: May 10, 2022

(54) ENHANCED WELLBORE DESIGN AND METHODS

(71) Applicant: Donald J. Fry, Grand Junction, CO (US)

(72) Inventor: Donald J. Fry, Grand Junction, CO (US)

( * ) Notice: Subject to any disclaimer, the term of this patent is extended or adjusted under 35 U.S.C. 154(b) by 93 days.

(21) Appl. No.: 16/495,735

(22) PCT Filed: Jan. 5, 2018

(86) PCT No.: PCT/US2018/012597
§ 371 (c)(1),
(2) Date: Sep. 19, 2019

(87) PCT Pub. No.: WO2018/174987
PCT Pub. Date: Sep. 27, 2018

(65) Prior Publication Data

US 2020/0024938 A1 Jan. 23, 2020

Related U.S. Application Data

(60) Provisional application No. 62/476,469, filed on Mar. 24, 2017.

(51) Int. Cl.
*E21B 43/30* (2006.01)
*E21B 7/04* (2006.01)
(Continued)

(52) U.S. Cl.
CPC ..... *E21B 43/305* (2013.01); *E21B 7/04* (2013.01); *E21B 17/20* (2013.01); *E21B 43/14* (2013.01); *E21B 43/16* (2013.01); *E21B 43/26* (2013.01)

(58) Field of Classification Search
CPC ..... E21B 43/305; E21B 7/04; E21B 17/20; E21B 43/14; E21B 43/16; E21B 43/17; E21B 43/26
See application file for complete search history.

(56) References Cited

U.S. PATENT DOCUMENTS 5,511,616 A 4/1996 Bert
5,762,149 A 6/1998 Donovan et al.
(Continued)

FOREIGN PATENT DOCUMENTS

WO 2016077239 A1 5/2016
WO 2016138005 A1 9/2016
(Continued)

OTHER PUBLICATIONS

Foreign Communication from a Related Counterpart—International Preliminary Report on Patentability, dated Oct. 3, 2019, PCT Application No. PCT/US2018/012597, filed on Jan. 5, 2018.
(Continued)

*Primary Examiner* — Michael R Wills, III
(74) *Attorney, Agent, or Firm* — Andrew M. Metrailer; Conley Rose, P.C.

(57) ABSTRACT

A wellbore completion comprises a borehole extending into a subterranean formation, a first portion of the borehole disposed within at least one production zone of the subterranean formation, and one or more completion zones within the first portion of the wellbore. The first portion maintains a high dog-leg severity throughout the first portion, and the one or more completions are configured to allow for fluid communication between an interior of the borehole and the subterranean formation.

23 Claims, 7 Drawing Sheets

(51) Int. Cl.

| | |
|---|---|
| ***E21B 17/20*** | (2006.01) |
| ***E21B 43/14*** | (2006.01) |
| ***E21B 43/26*** | (2006.01) |
| ***E21B 43/16*** | (2006.01) |

(56) References Cited

U.S. PATENT DOCUMENTS

| | | | | |
|---|---|---|---|---|
| 7,878,270 | B2 * | 2/2011 | Lee | E21B 43/305 175/61 |
| 2003/0173072 | A1 | 9/2003 | Vinegar et al. | |
| 2006/0124360 | A1 | 6/2006 | Lee et al. | |
| 2015/0060043 | A1 | 3/2015 | Breit et al. | |
| 2015/0090455 | A1 | 4/2015 | Balczewski | |
| 2016/0108679 | A1 | 4/2016 | Bayliss | |
| 2017/0248006 | A1 * | 8/2017 | Hess | E21B 43/17 |
| 2018/0023375 | A1 * | 1/2018 | Potapenko | E21B 43/114 166/308.1 |
| 2019/0226282 | A1 * | 7/2019 | Potapenko | E21B 43/25 |

FOREIGN PATENT DOCUMENTS

| | | | | |
|---|---|---|---|---|
| WO | WO-2016138005 | A1 * | 9/2016 | E21B 7/04 |
| WO | 2018174987 | A1 | 9/2018 | |

OTHER PUBLICATIONS

Foreign Communication from a Related Counterpart—International Search Report and Written Opinion, dated Mar. 28, 2018, PCT Application No. PCT/US2018/012597, filed on Jan. 5, 2018.

Fry, Donald J., entitled, "Drilling Wells with High Dog-Leg Severity Angle, Generating Enhanced Fracturing, Porosity, Completions, and Well Design." U.S. Appl. No. 62/476,469, filed Mar. 24, 2017.

* cited by examiner

ENHANCED WELLBORE DESIGN AND METHODS

CROSS-REFERENCE TO RELATED APPLICATIONS

This application is a filing under 35 U.S.C. 371 as the National Stage of International Application No. PCT/US2018/012597, filed on Jan. 5, 2018, entitled, "ENHANCED WELLBORE DESIGN AND METHODS," which claims the benefit of and claims priority to U.S. Provisional Application No. 62/476,469 filed Mar. 24, 2017 and entitled "Drilling Wells with High Dog-Leg Severity Angle, Generating Enhanced Fracturing, Porosity, Completions, and Well Design," both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores can be drilled into subterranean formations to provide access to various reservoirs such as hydrocarbon resources (e.g., gas, oil, etc.), water, and other underground resources. In various types of drilling, wellbores can be created through directional drilling techniques that extend down to a reservoir and then have extended length lateral wells that attempt to pass through the production zone of the reservoir. However, such completions can be expensive while providing limited access to reserves within a reservoir.

SUMMARY

In an embodiment, a method for forming a wellbore comprises drilling a wellbore into at least one production zone in a subterranean formation, maintaining a high dog-leg severity within a first portion of the wellbore, and completing the wellbore within the first portion. The first portion is in the at least one production zone.

In an embodiment, a wellbore completion comprises a borehole extending into a subterranean formation, a first portion of the borehole disposed within at least one production zone of the subterranean formation, and one or more completion zones within the first portion of the wellbore. The first portion maintains a high dog-leg severity throughout the first portion, and the one or more completions are configured to allow for fluid communication between an interior of the borehole and the subterranean formation.

In an embodiment, a method for forming a wellbore comprises drilling a wellbore into a subterranean formation having a multi-layered reservoir, maintaining a high dog-leg severity within a first portion of the wellbore, and completing the first portion of the wellbore within at least one producing layer of the plurality of producing layers. The multi-layered reservoir comprises a plurality of producing layers and at least one non-producing layer disposed between two or more producing layers or the plurality of producing layers. The first portion passes through the plurality of producing layers.

In an embodiment, a wellbore completion comprises a borehole extending into a subterranean formation comprising a multi-layered formation, a first portion of the borehole disposed through the multi-layered formation, and one or more completions within the first portion of the wellbore. The multi-layered reservoir comprises a plurality of producing layers and at least one non-producing layer disposed between two or more producing layers or the plurality of producing layers. The first portion maintains a high dog-leg severity throughout the first portion, and the first portion passes through the plurality of producing layers. The one or more completions are configured to allow for fluid communication between an interior of the borehole and the subterranean formation in at least one producing layer of the plurality of producing layers.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
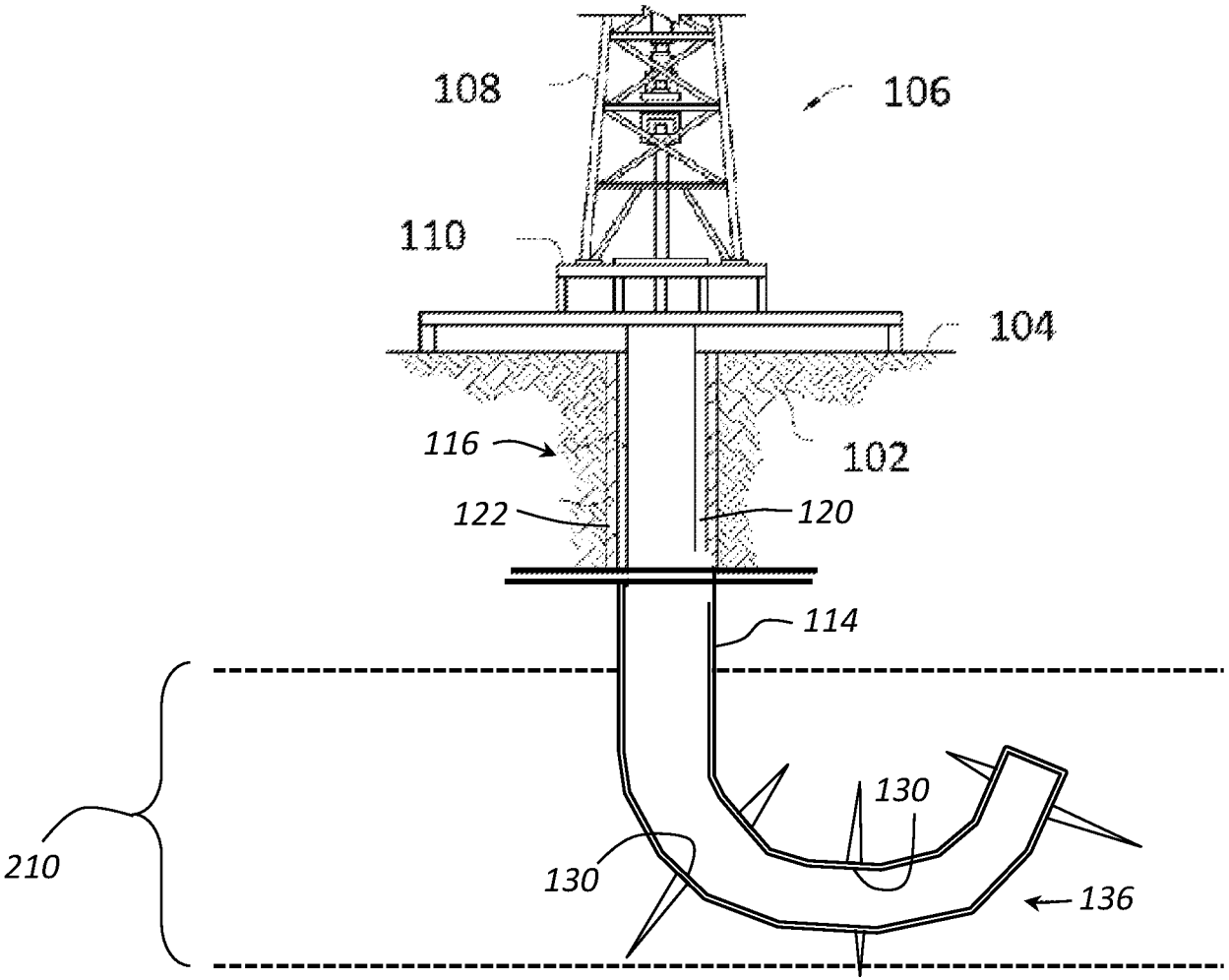
FIG. 1 illustrates a schematic representation of an embodiment of a wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Current methods of drilling, completing, and draining a reservoir can use extended length lateral wells with accompanying completions. These current production techniques involving extended length lateral wells can result in excessive cost.

In the methods and systems described herein, shorter lateral portions that can generate more porosity and effective fracturing can be used. The ability to use shorter wellbore sections can result in a significant reduction in cost while maintaining high production and effective draining of the reservoir.

Specifically, the present description is directed to the use of enhanced wellbore shapes and drilling processes to create the enhanced porosity and fracturing potential. This method allows for a shorter lateral length having an enhanced shape, and with this well shape and drilling process creates enhanced porosity, fracturing and completions. The wellbores can use an Enhanced-J and/or Enhanced-U shape to more effectively stimulate and drain the overall oil and gas reservoir, as described in more detail herein.

Within the described wellbore shape, a substantially continual, purposeful high Dog Leg Severity (DLS) can be used to generate near wellbore porosity and pathways for effective additional fracturing, leading to higher production with a shorter overall well length and fewer perforations and completion stages. As used herein, the DLS is defined as a measure of the amount of change in the inclination and/or direction of a borehole and is expressed in degrees per 100 feet of well bore length. The ability to use shorter production interval lengths saves costs, allows the wells to be drilled with smaller rigs, completed with fewer completion stages, and uses less sand/proppant, water, chemicals, and time.

In various embodiments as described herein, methods according to the present disclosure can include drilling a wellbore such that the wellbore enters the reservoir with a high DLS and maintains that high DLS through an entire 'Enhanced J' or 'Enhanced U' well shape, or any additional shape utilizing these techniques. The specifics of the wellbore and drilling will vary depending on the specific attributes of the reservoir and formation or formations being accessed with the wellbore. Once drilled, the wellbore can be completed within one or more production zones. For example, the wellbore can be perforated and hydraulically fractured within the high DLS sections. The near wellbore fractures created by the drilling with the high DLS may enhance the completion processes. Further, a wellbore having a shortened length and shape may allow for fewer completion stages, leading to cost savings in all aspects of the well and processes.

Drilling through an oil or gas reservoir with a high DLS creates enhanced porosity and fracturing along the wellbore. This enhanced fracturing not only improves localized production, but further acts as a zone conducive to additional effective completion fracturing with associated higher production. The above attributes result in a well that is shorter than an extended lateral, as well as requiring fewer completion stages, both of which mean lower costs. In addition, these techniques allow for more effective and complete reservoir drainage.

Reservoir attributes and boundaries factor into the drilling of the wellbore having the DLS, while not creating excessively deviated wellbores. The reservoir will further help to define both the overall height and length of an effective well. The drilling rig used to form the wellbore should be capable of maintaining high DLS through the entire reservoir, while also holding sufficient WOB (weight on bit) in order to complete a full 'Enhanced J' or 'Enhanced U' well shape. Utilizing bits capable of both high DLS and enhanced near-wellbore fracturing could offer improved results. While most wells target one specific reservoir, the unique shape of the 'Enhanced U' well could, within constraints, effectively target multiple vertical reservoirs across a large aerial extent with a single well.

The present systems and methods can also provide a more effective coverage of an entire reservoir. Many extended length lateral wells may impact the reservoir in a limited sense along their path, even when great lateral lengths are present. However, this arrangement may also leave large portions of the reservoir virtually untouched. The use of the shorter wellbore described herein may impact the full reservoir in multiple orientations. Acreage and existing well spacing constraints often keep extended length laterals from even being possible as they simply do not fit within the confines of the reservoir boundaries. In contrast, wells using these new techniques most often will fit, and can be highly effective in all drilling locations.

While the primary use of these drilling and completion techniques may be for hydrocarbon (e.g., oil and gas) production, the techniques could also be used in targeting any product where similar drilling and completions are utilized, for example water wells or water disposal wells.

Referring to FIG. 1, an example is shown of a wellbore operating environment having a wellbore formed as described herein. As depicted, the operating environment comprises a workover and/or drilling rig 106 that is positioned on the earth's surface 104 and extends over and around a wellbore 114 that penetrates a subterranean formation 102 for the purpose of recovering hydrocarbons. In some contexts, the wellbore 114 passing through the subterranean formation 102 can also be referred to as a borehole. The wellbore 114 may be drilled into the subterranean formation 102 using the drilling and completion techniques as described herein. The wellbore 114 extends substantially vertically away from the earth's surface 104 over a vertical wellbore portion 116 and deviates from vertical relative to the earth's surface 104 over a deviated wellbore portion 136, as described in more detail herein. The deviation is shown exaggerated in FIG. 1 for purposes of illustration. In some embodiments, the wellbore 114 may have one or more portions that are substantially horizontal. The wellbore may be a new wellbore, an existing wellbore, a sidetracked wellbore, a multi-lateral wellbore, and other types of wellbores. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular string 120 in the form of a completion assembly string disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular string 120 may operate in any of the wellbore orientations (e.g., vertical, deviated, horizontal, and/or curved) and/or types described herein. In an embodiment, the wellbore may comprise wellbore casing, which may be cemented into place in the wellbore 114.

In an embodiment, the wellbore tubular string 120 may comprise a completion assembly string comprising one or more wellbore tubular types and one or more downhole tools (e.g., zonal isolation devices, screens, valves, etc.). The one or more downhole tools may take various forms.

The workover and/or drilling rig 106 may comprise a derrick 108 with a rig floor 110 through which the wellbore tubular string 120 extends downward from the drilling rig 106 into the wellbore 114. The workover and/or drilling rig 106 may comprise a motor driven winch and other associated equipment for conveying the wellbore tubular string 120 into the wellbore 114 to position the wellbore tubular string 120 at a selected depth.

While the operating environment depicted in FIG. 1 refers to a stationary workover and/or drilling rig 106 for conveying the wellbore tubular string 120 within a land-based wellbore 114, in alternative embodiments, mobile workover rigs, wellbore servicing units (such as coiled tubing units), and the like may be used to convey the wellbore tubular string 120 within the wellbore 114. It should be understood that a wellbore tubular string 120 may alternatively be used in other operational environments, such as within an offshore wellbore operational environment.

The wellbore 114 can be completed within a desired reservoir 210 using a variety of techniques. As noted with respect to FIG. 1, the wellbore 114 can have a casing or other completion assembly (e.g., a gravel pack, liner, etc.) placed into the wellbore. In some embodiments, the wellbore can be completed using casing that is cemented in place or otherwise using a liner of various types. When the wellbore 114 is completed using casing as the wellbore tubular 120, a generally tubular casing string 120 can be positioned within wellbore 114 and secured using a cement sheath 122 that is placed in the annulus between the casing string 120 and the wellbore wall in accordance with any conventional technique.

Once the casing string 120 is set in the wellbore 114, the casing string 120 can be perforated and/or the formation can be hydraulically fractured. Perforating generally involves igniting a plurality of perforating charges coupled by a detonation cord. When detonated, the perforating charges can blast through a perforating charge carrier (e.g., through a scallop or thinned area in the carrier) and create a perforation 130 that extends or penetrates through the casing string 120 and cement 122 into the reservoir 210. Fluids within the reservoir 210 can then communicate through the perforations into the interior of the casing string 120.

The wellbore 114 can be hydraulically fractured as part of or after perforating the casing string 120. Fracturing generally begins by placing a completion assembly within the wellbore. The completion assembly can comprise one or more isolation plugs or packers, tubing strings and isolation valves or sleeves. The completion assembly can be used to isolate a portion of the wellbore that is to be hydraulically fractured while providing fluid communication with the surface for purposes of providing pressure and fluid useful in fracturing the formation. Any suitable tools can be used to configure the well and the completion assembly for the hydraulic fracturing including tubing conveyed tools, wireline deployed tools, coiled tubing deployed tools, and/or hydraulically conveyed tools.

Once positioned in the wellbore, the completion assembly can be adjacent to and isolate the zone to be hydraulically fractured. Hydraulic fracturing fluid can be pumped down a tubing string forming part of the completion assembly into the annulus between tubing string and the casing string 120 within the zone isolated by the completion assembly. The fracturing fluid may be any fluid deemed to have the proppant carrying properties as dictated by the reservoir 210 of interest and completion method employed. Suitable carrier fluids include gels, for example hydroxyethylcellulose or crosslinked polymers. Water can be sufficient for certain applications, such as a high rate water pack in which the primary emphasis is packing perforations and the annulus without fracturing the formation. Pressure on the fracturing fluid can be increased to a pressure that is significantly greater than the formation pressure such that the formation is subjected to a pressure condition that is in excess of the formation fracture gradient, thereby fracturing the formation. The high pressure fluid present in the annulus can be injected into the formation or zone through the perforations 130 at a high rate and pressure. The fluid used in the hydraulic fracturing operation can carry proppant, which can deposit in the fractures created in the formation and serve as a pathway through which formation fluids can travel into the perforations 130 and the wellbore 114.

Once perforated, the completion assembly can be moved to a new location to hydraulically fracture the next zone or portion of the wellbore. In this manner, a series of hydraulic fracturing operations can be carried out to hydraulically fracture a desired portion of the wellbore. Once the hydraulic fracturing operations are complete, the fracturing assembly can be removed from the wellbore, and a production assembly can be placed in the wellbore 114. The production assembly can comprise one or more tubular strings, plugs, packers, screens, or the like that can serve to collect and channel any fluids passing into the wellbore through the perforations to the surface.

While described above as being completed with casing, a liner, gravel pack, or other completion technique, the wellbore can also include one or more open hole sections. As used herein, open hole completions can include true open-hole completions, slotted-or perforated-liner completions, liner completions with external casing packers, and the like. The wellbore can then be hydraulically fractured using various techniques such as fracturing using a jetting tool to fracture an open hole section. Suitable methods are available (e.g., such as the use of the SurgiFrac process available from Halliburton Energy Services of Houston, Tex.). These methods allow the wellbore to be fractured as described herein regardless of the type of wellbore completion process. Thus, the techniques and wellbore configurations described herein can be used in a variety of wellbore completions and arrangements.

Figure 2:
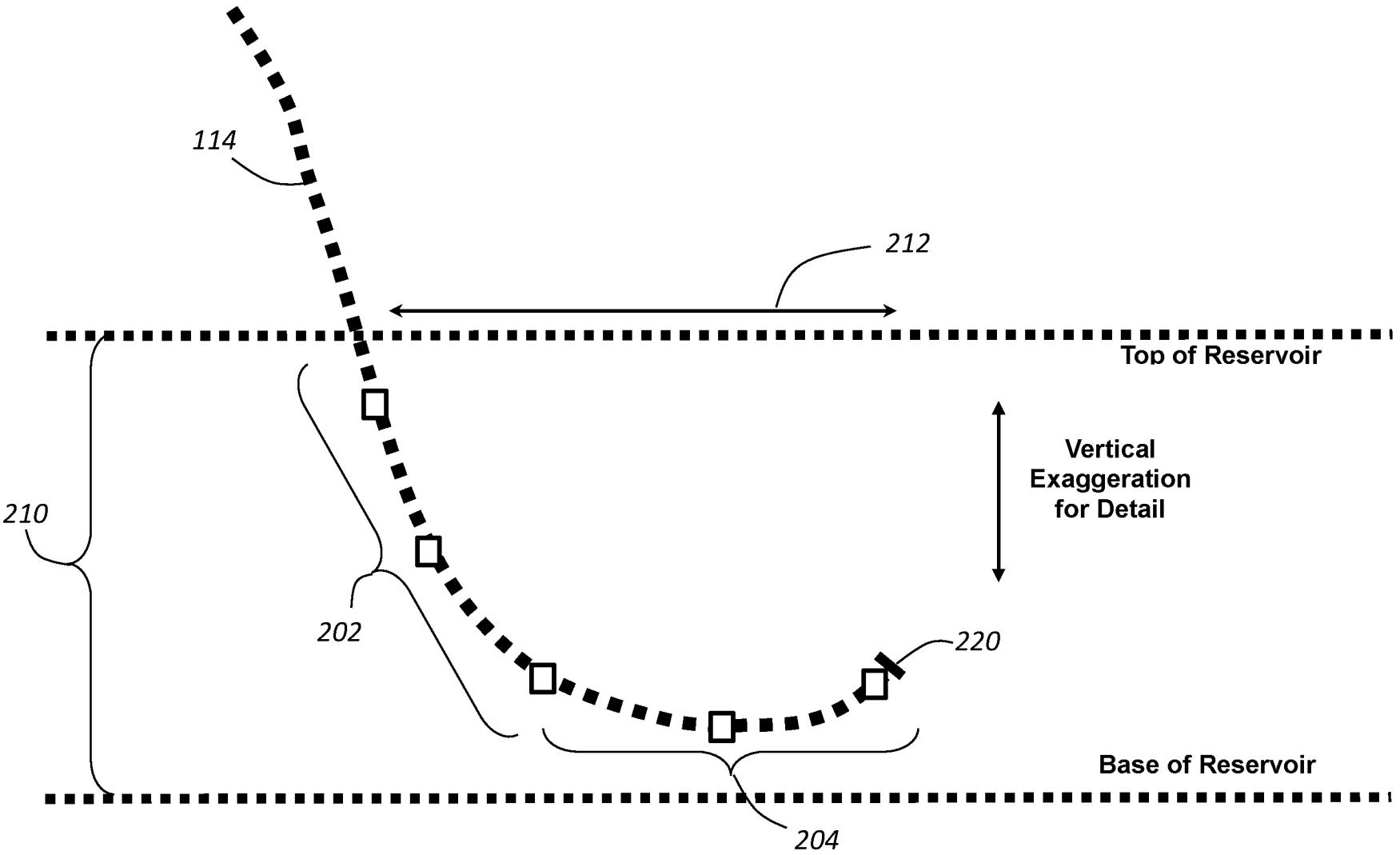
FIG. 2 illustrates a schematic representation of a wellbore configuration according to an embodiment.

FIG. 2 illustrates a schematic view of a wellbore having a portion of the wellbore having a high DLS. As shown in FIG. 2, the "heel" portion 202 of the wellbore can be defined as any portion of the wellbore that is within the reservoir(s) 210, but is not a part of the horizontal or near-horizontal wellbore path. In some embodiments, multiple heel portions can exist and may come both before and/or after the landing zone of a well. The "landing" portion 204 or "landing zone" is defined as the zone where a well bore reaches a horizontal or near-horizontal path.

As shown in FIG. 2, the wellbore may comprise a heel portion 202 having a high DLS along with a landing portion 204. This design can be referred to as an enhanced J wellbore in some contexts as the wellbore generally resembles a J. As shown in FIG. 2, the wellbore can have a high DLS throughout the heel portion 202, and in some embodiments, throughout the landing portion 204 along with any downhole heel portions. While not intending to be limited by theory, it is believed that the use of a high DLS for the wellbore portion within the reservoir 210 can cause the bit used to drill the wellbore to dig or bite into the wellbore sides, thereby generating localized fracturing and porosity. The resulting zone around the wellbore 114 may then be more conducive to the origination of additional effective fracturing during a completion process. As a result, the wellbore having the high DLS throughout the heel portion 202 and/or the landing portion 204 can be completed within the zone having the high DLS to provide an improved wellbore. Such a wellbore may provide a fracturing pattern coverage that extends laterally out within the reservoir as well as potentially to the upper and lower layers of a given reservoir. This may help to access the hydrocarbons or other fluids within the targeted reservoir or reservoir layer.

The specific DLS used for a wellbore will vary based on certain properties of the wellbore and the formation. For example, the range of angles of the DLS selected for the wellbore 114 may be determined based on an overall thickness of the targeted reservoir, the overall length of the wellbore being drilled, the reservoir rock qualities, the specific reservoir or reservoirs being targeted, and the like. In some embodiments, the wellbore 114 can have a DLS of at least about 8 degrees, at least about 10 degrees, at least about 12 degrees, at least about 14 degrees, or at least about 16 degrees. In some embodiments, the wellbore 114 can have a DLS at the technical high DLS drilling capabilities, where the increased DLS angle may provide better localized fracturing and porosity as well as resulting in an enhanced wellbore. In some embodiments, the wellbore 114 can have a DLS of about 18 degrees or less, about 20 degrees or less, or about 22 degrees or less. The DLS of the wellbore 114 can be in a range between any of the lower values and any of the upper values described herein. In some embodiments, the DLS angle can vary over the length of the wellbore 114 within the reservoir 210 while remaining within the ranges described herein.

The use of the DLS with the wellbore 114 may result in a relatively short wellbore within the reservoir 210. In some embodiments, the length of the wellbore 114 starting from an entrance into the first reservoir boundary may be less than about 4,000 ft., less than about 3,500 ft., less than about 3,000 ft., less than about 2,500 ft., or less than about 2,000 ft. This may be less than a traditional horizontal or inclined lateral wellbore passing outwards through a reservoir layer that can extend a mile or more. The resulting wellbore can have a horizontal or lateral spacing 212 within the reservoir 210 extending from a point at which the wellbore 114 enters the reservoir to a termination point 220 and/or a point at which the wellbore exits the reservoir 210 of less than about 3,000 ft., less than about 2,500 ft., less than about 2,000 ft., or less than about 1,500 ft. While the horizontal or lateral spacing 212 may be relatively short, the resulting wellbore 114 can have enhanced properties that provide access to an increased area and reserves around the wellbore 114.

The wellbore can be drilled using any appropriate drilling technique suitable for creating the DLS through the heel portion 202, and optionally, into the landing portion 204. Various considerations such as the ability to maintain the DLS throughout the heel portion 202 and the landing portion 204, the ability to maintain weight on the bit (WOB), and the ability to complete the wellbore (e.g., placing casing through the high DLS portions, etc.) may be factored into the drilling program for the wellbore. Overall, the wellbore as described herein may be relatively short compared to similar completions using long lateral wellbore portions. As a result, the various drilling considerations such as maintaining adequate WOB may be based on the overall length of the enhanced wellbore. Once drilled, the wellbore can be completed within the portions of the wellbore having the high DLS such as the heel portion 202, and optionally, the landing portion 204 using various techniques, as described in more detail herein.

Figure 3:
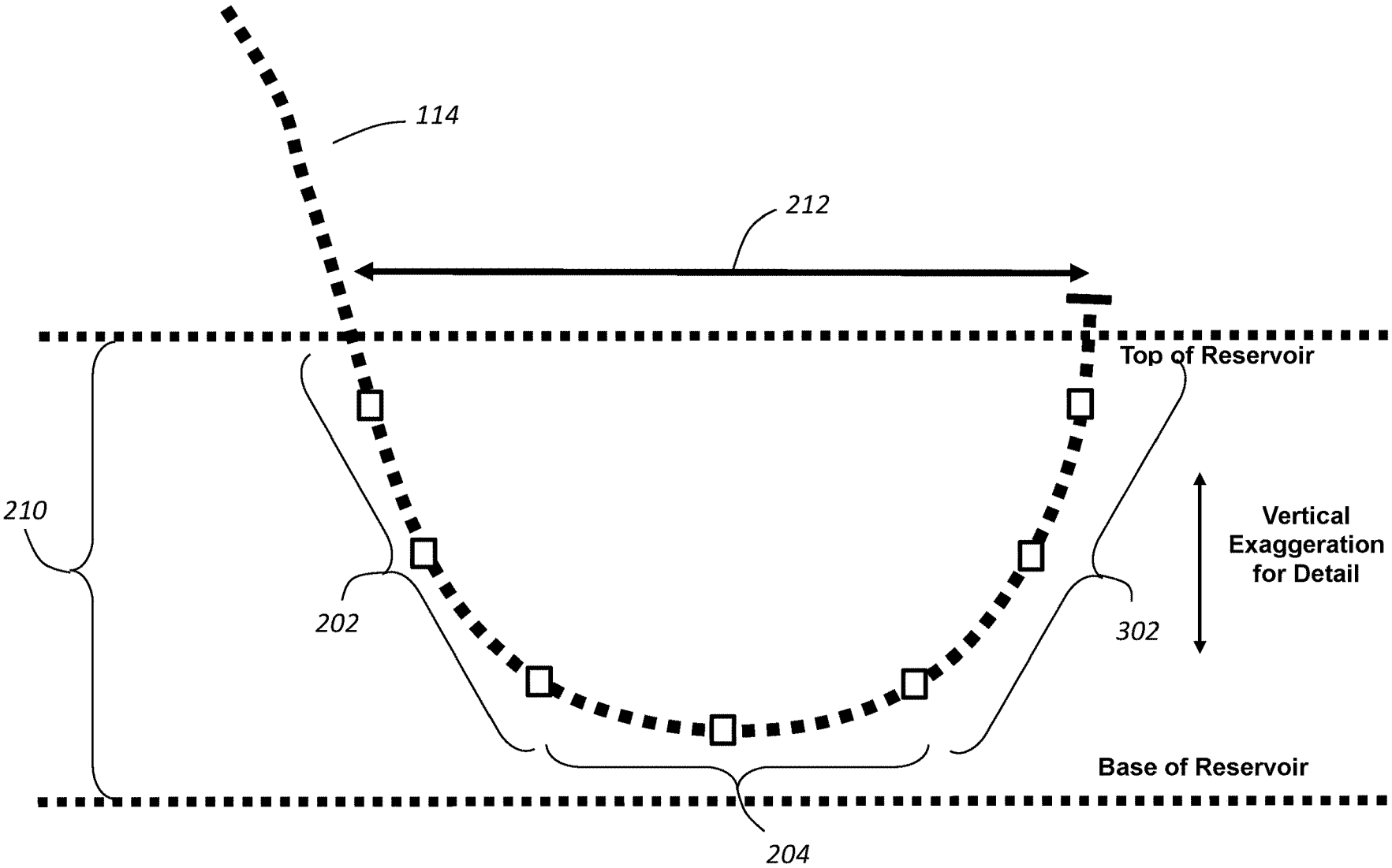
FIG. 3 illustrates another schematic representation of a wellbore configuration according to an embodiment.

FIG. 3 illustrates another schematic view of a wellbore having a portion of the wellbore having a high DLS. The wellbore 114 of FIG. 3 is similar to the wellbore 114 of FIG. 2, and similar elements are shown with the same reference numbers. As shown in FIG. 3, the wellbore 114 has a heel portion 202 followed by a downhole landing portion 204. A second heel portion 302 is further disposed downhole from the landing portion 204. This configuration can be referred to as an enhanced U design in some contexts.

In an embodiment, the first heel portion 202, the landing portion 204, and the second heel portion 302 can have a high DLS, which can be substantially continuous between all three portions 202, 204, 302. The angle of the DLS within the heel portion 202, the landing portion 204, and/or the heel portion 302 can be between about 8 and about 16 degrees, or between about 10 and about 15 degrees. The wellbore can have a length and/or horizontal or lateral spacing 212 within the reservoir as described with respect to the wellbore 114 of FIG. 2. Once drilled, the wellbore 114 can be completed within the portions of the wellbore having the high DLS such as the heel portion 202, the landing portion 204, and/or the second heel portion 302 using various techniques, as described in more detail herein.

In some embodiments, the wellbore 114 can be defined by a plurality of downhole coordinates. The coordinates can be used in the drilling process as targets to define the relative DLS of the wellbore 114. For example, an enhanced J wellbore configuration can be defined by two or more coordinates (e.g., x-y-z coordinates, any other coordinates, etc.) such as an entrance point into the reservoir 210 and a landing point. The points and/or coordinates can also describe a relative angle or orientation of the wellbore at the respective coordinate(s). Similarly, an enhanced U wellbore configuration can be defined by two or more coordinates such as an entrance point, a landing point, and a termination point. The points and/or coordinates can describe a relative angle or orientation, and/or the wellbore 114 can represent a best fit wellbore to the coordinates. The resulting plurality of coordinates can then be used to define the path of the wellbore 114 as well as the DLS angle or angular range over the length of the portion of the wellbore 114 subject to the completion processes.

Figure 4:
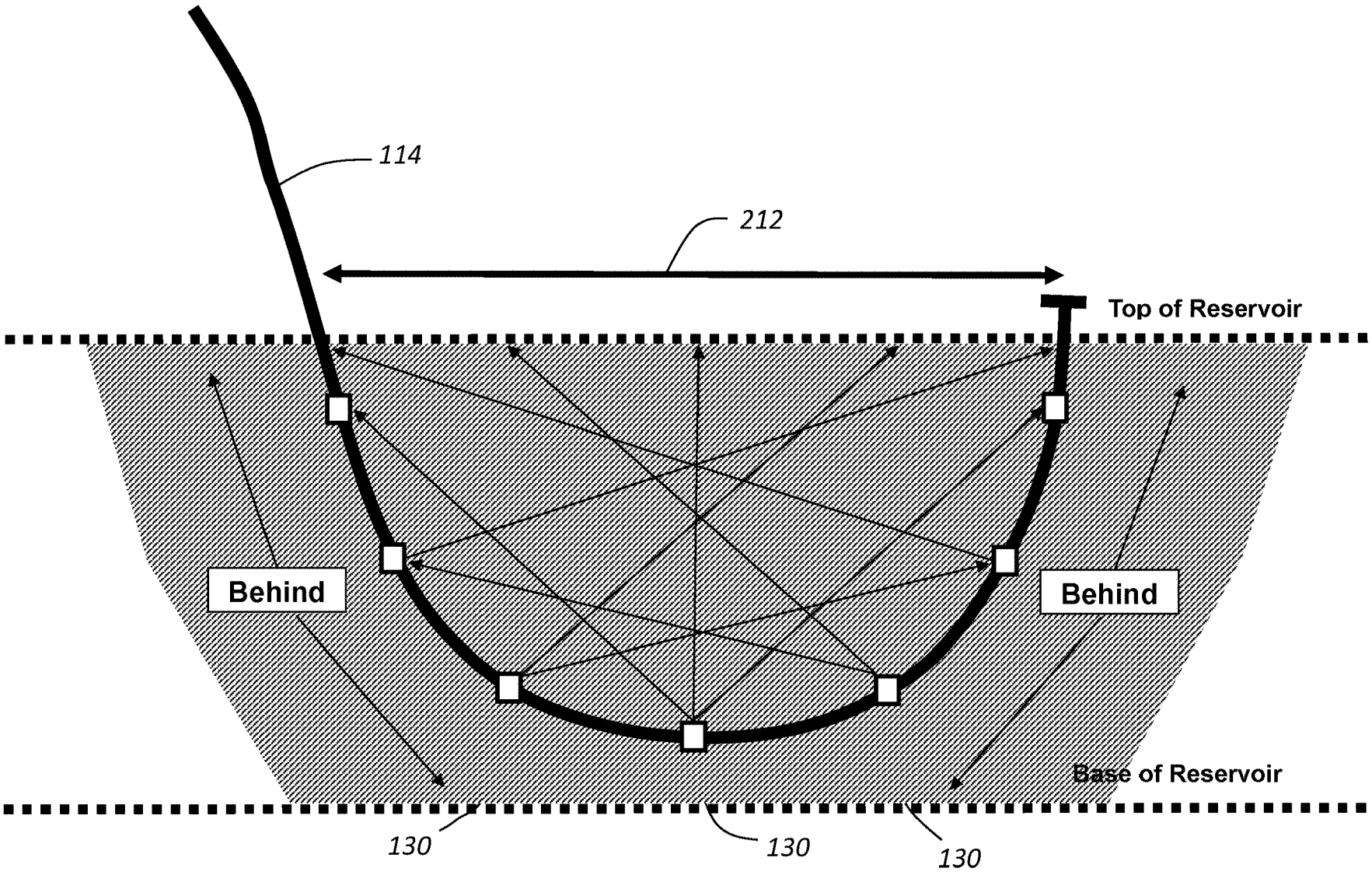
FIG. 4 illustrates a schematic representation of a fracturing pattern for a wellbore configuration according to an embodiment.

The wellbore 114 can be completed using a variety of techniques including perforating and hydraulic fracturing as described herein. FIG. 4 illustrates a schematic representation of a hydraulically fractured wellbore having a high DLS. The ability to fracture the wellbore within the high DLS portion allows for effective completions that have the potential to result in high production at a reduced cost relative to longer length lateral completions.

As shown in FIG. 4, the resulting fractures, for example initiated through the perforations 130, may extend in multiple orientations including laterally, and vertically. The lateral extent of the fractures can pass outside the area between the portions of the enhanced wellbore configuration. The vertical extent of the fractures may extent to the upper and lower boundaries of a given reservoir zone. Further, the fractures that result from completing the wellbore within the high DLS portion may intersect or overlap and cross between the heel portion 202, the landing portion 204, and/or the second heel portion 302. This form of complex overlapping of fractures between multiple and separate completion points along the wellbore 114 may form an intersecting web of fractures that can result in a highly porous and effective completion within and around the wellbore 114. The resulting fracture structure may be based on the use of the high DLS wellbore such that the drilling technique and resulting wellbore configuration may help to create a near-wellbore fracturing that promotes extended fracturing within the formation.

Figure 5:
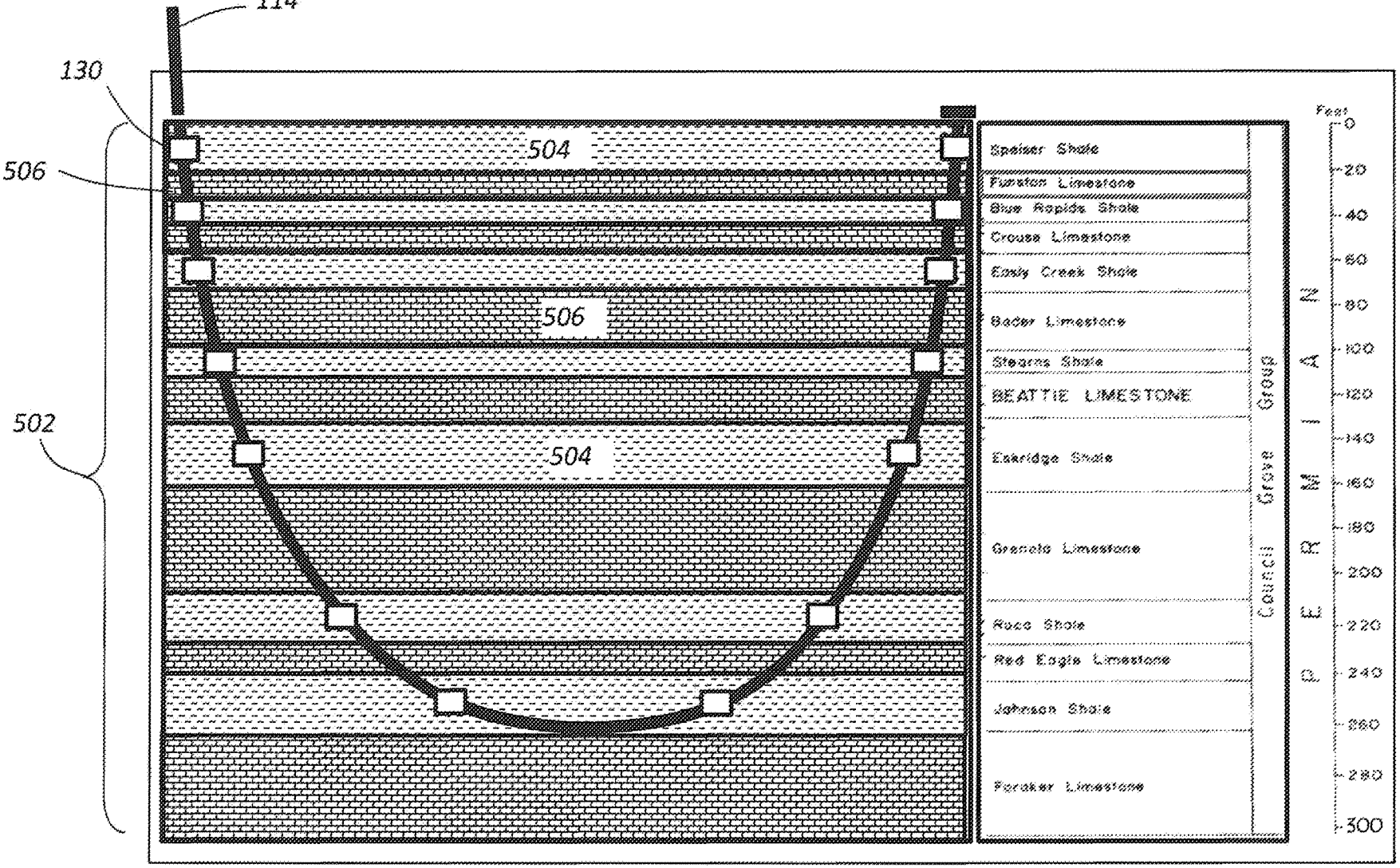
FIG. 5 illustrates a schematic representation of a wellbore configuration in a multi-layered reservoir according to an embodiment.

The wellbore configurations described above can also be used across multiple production zones within a subterranean formation. FIG. 5 shows a schematic representation of a multi-layered or multi-zone reservoir 502. The reservoir 502 can have a plurality of producing layers 504 along with one or more non-producing layers 506. As shown in FIG. 5, the producing layers 504 can be interlayered with the non-producing layers 506 to produce a striated or layered configuration. While multiple layers are shown for purposes of illustration, the multi-layered reservoir 502 may have two or more producing layers 504 and one or more non-producing layers 506 between the two or more producing layers 504. While the layers 504, 506 are shown as being horizontal, it should be evident to one skilled in the art that such layers can take on a number of orientations within the subterranean formation, and each multilayer reservoir can have multiple layers 504, 506 while having unique configurations. While the wellbore 114 is shown entering vertically or substantially vertically in FIG. 5, the orientation of the wellbore entering a reservoir can be adjusted to allow the wellbore 114 to traverse the multi-layered reservoir 502 at a desired orientation with the high DLS angles.

As shown in FIG. 5, the wellbore 114 can be the same or similar to the wellbores described with respect to FIG. 2 and FIG. 3 in which the wellbore can have a high DLS within the heel portion 202, the landing portion 204, and/or the second heel portion 302. The wellbore 114 can be an enhanced J or enhanced U that crosses the plurality of producing layers 504. The wellbore 114 can be the same or similar and share any of the characteristics described herein with respect to the wellbore 114 of FIGS. 1-4.

The wellbore 114 can pass through the plurality of producing layers 504 and have a high DLS within the reservoir 502 as it passes through the producing layers 504. The wellbore can then be completed as described herein, including being completed within the plurality of producing layers 504 where the wellbore 114 has the high DLS. As shown in FIG. 5, the wellbore can enter a first or upper producing layer 504 and have one or more sets of perforations and/or hydraulic fractures within the first producing layer 504. As the wellbore 114 passes through the non-producing layer 506, the wellbore may not be completed within this layer 506. As a result, the wellbore may be selectively completed along its length in one or more producing layers 504 while maintaining the high DLS along its length.

The wellbore 114 of FIG. 5 can be completed across one or more producing layers 504 during each completion stage. For example, selective placement of a perforating string can be used to perforate the casing set in the wellbore across the one or more producing layers while avoiding the non-producing layers. A completion string can then isolate perforations across two or more producing layers 504 to effectively hydraulically fracture within a plurality of producing layers 504 in a single fracturing procedure, as described in more detail herein. The process can be completed across the desired completion length of the wellbore 114 to effectively complete the wellbore across the plurality of producing layers 504.

As shown in FIG. 5, the wellbore 114 may traverse one or more layers 504, 506 a plurality of times. The enhanced U wellbore shown in FIG. 5 passes through the upper most producing layer 504 before passing to the lower layers. The continued high DLS then brings the wellbore back through the upper most producing layer 504 to a second point in the second heel section 302. A number of the producing layers 504 can then be traversed by the wellbore 114 at least twice at spatial separate locations or points. This allows the wellbore to be completed within a producing layer at two different points that are separated from each other. This may allow for more complete fracturing across the producing interval that can be further enhanced by the use of the high DLS wellbore 114.

The fracturing of the formation as described with respect to FIG. 4 can occur within each producing layer 504 of the multi-layer reservoir 502. The non-producing layers 506 may serve as barriers to production and/or fracturing such that the fracturing within a producing layer 504 may be contained within that producing layer 504. Thus, the fracturing of the layers from the wellbore having the high DLS can result in an effectively fractured formation that extends around, laterally across, and vertically within the limits of the producing layer 504.

In some embodiments, the wellbore 114 can pass through a producing layer 504 a plurality of times. In these embodiments, the wellbore 114 can be completed at multiple, spaced apart points across the producing layer 504 (as opposed to simply multiple adjacent points along the length of the wellbore 114). This spacing of the completion points may allow for the portion of the producing layer that is effectively fractured to be extend between the two completion points as well as behind and round the area between the two completion points, as described herein. The resulting completions within one or more of the producing layers 504 may provide for an increased production from each producing layer 504 as compared to completing the wellbore 114 from a single point within such producing layer 504.

FIG. 5 illustrates a layered configuration having zones that can be identified as separable. In some reservoirs, the formation can contain mixed multi-zone layers comprising thin and poorly defined layers or various types of rock and formations such as shales, tight sands, coals, limestone, etc. In this type of formation, the layers may be represented by relatively thin layers that may not be uniform on a vertical or horizontal scale. However, the wellbore 114 can pass through the mixed layers as shown in FIG. 5, and the producing layers 504 identified in the same manner described herein to provide for an improved completion that can access a plurality of desired layers or zones.

The ability to complete a multi-layered reservoir 502 in a plurality of the producing layers 504 may have a number of advantages relative to a traditional lateral completion. In general, a single lateral completion would pass through and target a single producing layer. The remaining layers may not be accessed effectively due to the nature of the non-producing layers forming an effective block to fluid communication as well as a barrier to fracturing. By completing the wellbore 114 as an enhanced J or enhanced U configuration, a plurality of the producing layers 504 can be completed and accessed even in the presence of intervening non-producing layers 506.

Figure 6A:
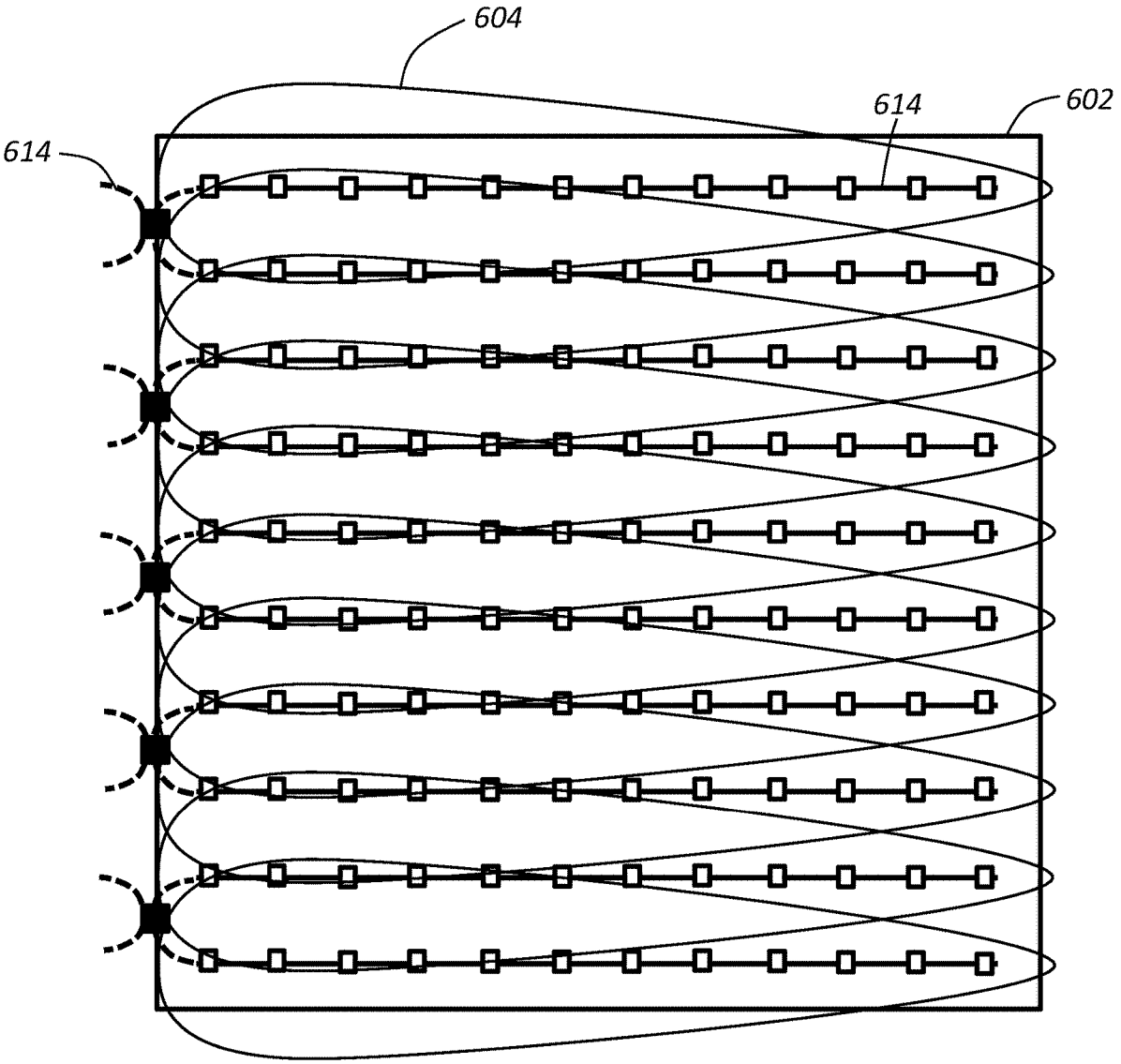
FIG. 6A illustrates a schematic plan view of a reservoir having a wellbore layout.

The wellbore configurations and completion techniques described herein can provide for the effective coverage across the lateral extent of a wellbore. Due to the ability to effectively access the reservoir as well as having a relatively shorter length, the resulting wellbore patterns and field layouts may be unique. FIG. 6A shows a schematic plan view of a formation 602 having a plurality of lateral wellbores 614 extending across the formation 602. The wellbores can be drilled from a common drilling pad, and would generally extend from one side of the formation 602 to the other side. In the wellbore 614, a plurality of perforations 130 and completion points would be distributed across the formation 602. Due to various considerations such as pressure loss, depth of the wellbore, and the like, the effective extent of the hydraulic fractures along the wellbore 614 may generally decrease. The fracturing pattern extent is shown as the outline 604, which can be seen in FIG. 6A to decrease from the top of the wellbore 614 towards the end of the wellbore 614. Multiple wellbores 614 are then used to attempt to cover the formation 602. It can be seen in FIG. 6A, that some areas remain inaccessible, and on a vertical scale, additional portions of the formation (e.g., producing layers above and below a completed layer) can be inaccessible using long lateral completion techniques.

Figure 6B:
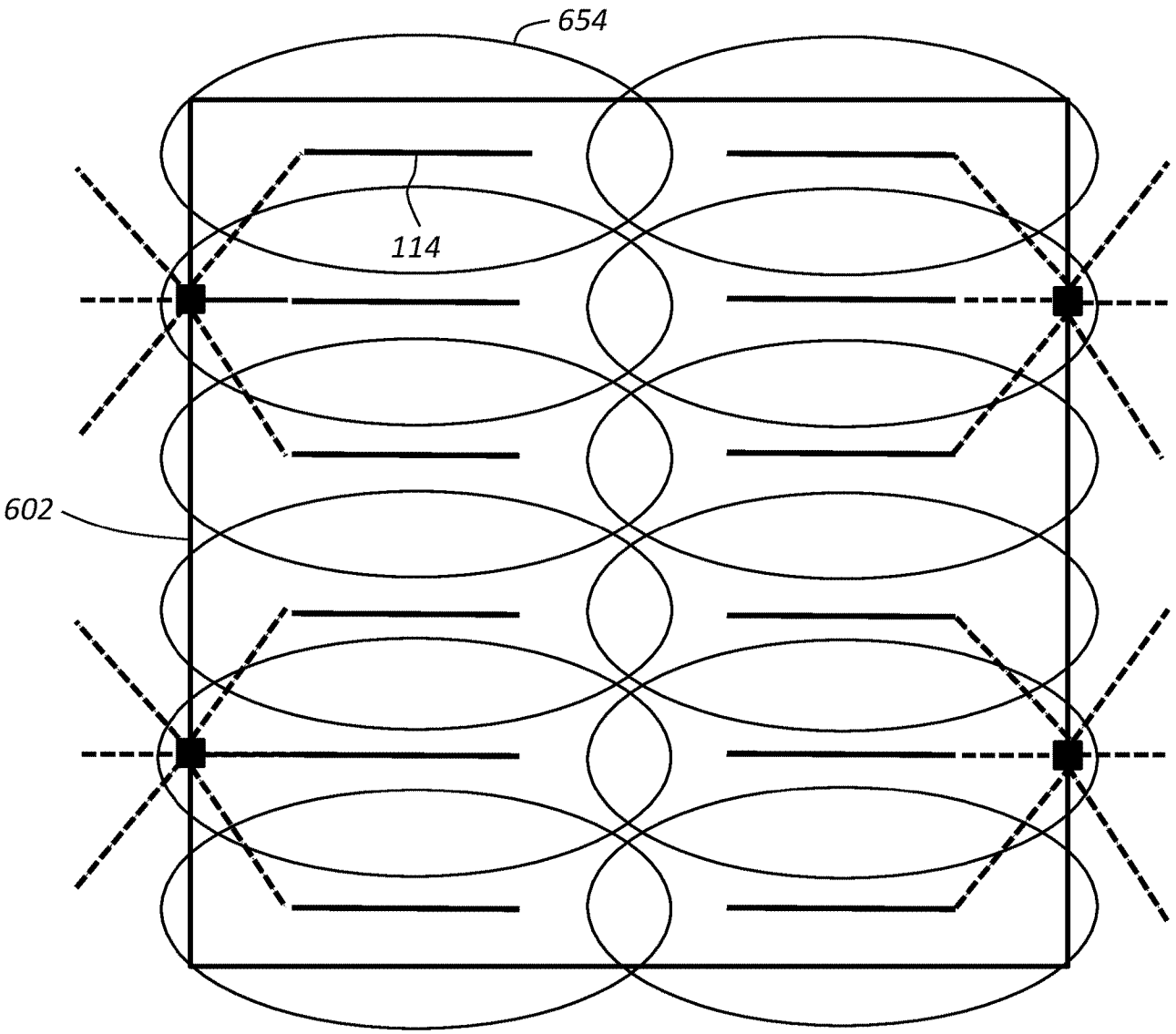
FIG. 6B illustrates another schematic plan view of a reservoir having another wellbore layout according to an embodiment.

FIG. 6B illustrates a schematic plan view of a formation 602 have a plurality of wellbores 114 configured as described herein with high DLS wellbore 114. As shown the wellbores 114 may be shorter than long lateral wellbores and can extend into the formation 602. Based on the enhanced fracturing patterns as described herein, the extent of the effectively fractured zones may be greater and generally more uniform than those of the lateral wellbore fractures, where the fracture zones from the wellbores 114 are shown with the outlines 654 in FIG. 6B. The fracture patterns demonstrate that more of the area of the formation 602 can be covered using the wellbores 114 as described herein than using long lateral wellbores. Moreover, the wellbores as described herein can also provide increased access to vertical producing layers within the formation as compared a lateral wellbore passing through a single producing layer. The increased extent of the fractured area around the wellbores 114 having the high DLS may also allow the number of wellbores used to access the reserves in a reservoir to potentially be decreased while maintaining a similar level of recovery.

The decreased size and length of the wellbores 114 allows these wellbores to be used for infill and edge well placements, where longer length laterals would not fit or would not be economic. The placement of these wellbores 114 allows the enhanced wellbores to be used with longer laterals in various patterns as well as to capture various vertically separated producing layers within a reservoir. In some embodiments, a reservoir may comprise one or more of the enhanced wellbore configurations as described herein in addition to one or more other wellbores having lateral or other configurations.

The wellbores described herein allow for a number of advantages over other techniques for accessing reserves within a reservoir. Initially, the wellbores as described herein may allow for access to similar or increased levels of production at a decreased cost. For example, the same or an increased level of production can be obtained at a cost of less than about 90%, less than about 80%, or less than about 70% of current costs. The cost savings can be obtained in part due to the decreased length of the wellbores along with few completion stages. This further allows for a reduction in the drilling pad size, the rig size, the casing size and amount of casing, the amount of proppant, the amount of fracturing fluids used, and the like.

The benefits of the wellbores as described here can be used in most, if not all, types of reservoirs to access the reserves. The wellbores can be used across single reservoir zones, layered or stacked reservoir zones, and/or stacked intermittent or mixed layered reservoir zones. Further, the wellbores have the ability to access multiple producing layers within a reservoir as compared to the ability of long lateral wellbores to primarily only access a single producing layer. The increased access to the reserves also allows for more of the reserves from a reservoir to be accessed. This can improve the economics of the wellbores for a given reservoir or field.

Having described numerous devices, systems, and method herein, various embodiments can include, but are not limited to:

In a first embodiment, a method for forming a wellbore comprises: drilling a wellbore into at least one production zone in a subterranean formation; maintaining a high dog-leg severity within a first portion of the wellbore, wherein the first portion is in the at least one production zone; and completing the wellbore within the first portion.

A second embodiment can include the method of the first embodiment, wherein a first end of the first portion of the wellbore begins at an entrance point of the wellbore into the at least one production zone, and wherein a second end of the first portion of the wellbore has a vertical angle of less than 90 degrees with respect to a vertical angle of the first end of the first portion of the wellbore.

A third embodiment can include the method of the first or second embodiment, wherein the high dog-leg severity has an angle of between about 8 and about 16 degrees per 100 feet of wellbore length.

A fourth embodiment can include the method of any of the first to third embodiments, wherein completing the wellbore within the first portion comprises: setting casing within the first portion; and perforating the casing within the first portion.

A fifth embodiment can include the method of any of the first to fourth embodiments, wherein completing the wellbore within the first portion comprises: hydraulically fracturing the subterranean formation within the at least one production zone from within the first portion.

A sixth embodiment can include the method of the fifth embodiment, further comprising: forming fractures in the subterranean formation both vertically and horizontally in response to hydraulically fracturing the subterranean formation within the at least one production zone from within the first portion A seventh embodiment can include the method of the sixth embodiment, wherein the fractures in the subterranean formation intersect between two or more fracturing points along a length of the wellbore.

An eighth embodiment can include the method of any of the first to seventh embodiments, wherein the first portion of the wellbore comprises a heel portion and a landing portion adjacent the heel portion.

A ninth embodiment can include the method of the eighth embodiment, wherein the first portion of the wellbore further comprises a second heel portion adjacent the landing portion.

A tenth embodiment can include the method of the ninth embodiment, wherein the high dog-leg severity is substantially maintained through the heel portion, the landing portion, and the second heel portion.

An eleventh embodiment can include the method of any of the first to tenth embodiments, further comprising: forming localized fracturing around the wellbore in the first portion in response to drilling the wellbore while maintaining the high dog-leg severity within the first portion of the wellbore.

A twelfth embodiment can include the method of any of the first to eleventh embodiments, wherein the first portion has a total length of about 4,000 feet or less.

In a thirteenth embodiment, a wellbore completion comprises: a borehole extending into a subterranean formation; a first portion of the borehole disposed within at least one production zone of the subterranean formation, wherein the first portion maintains a high dog-leg severity throughout the first portion; one or more completion zones within the first portion of the wellbore, wherein the one or more completions are configured to allow for fluid communication between an interior of the borehole and the subterranean formation.

A fourteenth embodiment can include the wellbore completion of the thirteenth embodiment, wherein a first end of the first portion of the wellbore begins at an entrance point of the wellbore into the at least one production zone, and wherein a second end of the first portion of the wellbore has a vertical angle of less than 90 degrees with respect to a vertical angle of the first end of the first portion of the wellbore.

A fifteenth embodiment can include the wellbore completion of the thirteenth or fourteenth embodiment, further comprising: near wellbore fractures surrounding the wellbore adjacent the first portion.

A sixteenth embodiment can include the wellbore completion of any of the thirteenth to fifteenth embodiments, wherein the high dog-leg severity has an angle of between about 8 and about 16 degrees per 100 feet of borehole length A seventeenth embodiment can include the wellbore completion of any of the thirteenth to sixteenth embodiments, further comprising: casing disposed within the borehole within the first portion; and one or more perforations disposed in the casing within the first portion.

An eighteenth embodiment can include the wellbore completion of the seventeenth embodiment, further comprising: hydraulic fractures within the subterranean formation extending from the one or more perforations.

A nineteenth embodiment can include the wellbore completion of the eighteenth embodiment, wherein the one or more perforations comprise a plurality of perforations, and wherein the hydraulic fractures intersect between at least two of the plurality of perforations.

A twentieth embodiment can include the wellbore completion of any of the thirteenth to nineteenth embodiments, wherein the first portion of the borehole comprises a heel portion and a landing portion adjacent the heel portion.

A twenty first embodiment can include the wellbore completion of the twentieth embodiment, wherein the first portion of the wellbore further comprises a second heel portion adjacent the landing portion.

A twenty second embodiment can include the wellbore completion of the twenty first embodiment, wherein the high dog-leg severity is substantially maintained through the heel portion, the landing portion, and the second heel portion.

A twenty third embodiment can include the wellbore completion of any of the thirteenth to twenty second embodiments, wherein the first portion has a total length of about 4,000 feet or less.

In a twenty fourth embodiment, a method for forming a wellbore comprises: drilling a wellbore into a subterranean formation having a multi-layered reservoir, wherein the multi-layered reservoir comprises a plurality of producing layers and at least one non-producing layer disposed between two or more producing layers or the plurality of producing layers; maintaining a high dog-leg severity within a first portion of the wellbore, wherein the first portion passes through the plurality of producing layers; and completing the first portion of the wellbore within at least one producing layer of the plurality of producing layers.

A twenty fifth embodiment can include the method of the twenty fourth embodiment, wherein the high dog-leg severity has an angle of between about 8 and about 16 degrees per 100 feet of wellbore length.

A twenty sixth embodiment can include the method of the twenty fourth or twenty fifth embodiment, wherein completing the wellbore within the first portion comprises: setting casing within the first portion; and perforating the casing within the first portion.

A twenty seventh embodiment can include the method of any of the twenty fourth to twenty sixth embodiments, wherein the wellbore passes through a first producing layer of the plurality of producing layers at a first point and a second point.

A twenty eighth embodiment can include the method of the twenty seventh embodiment, wherein completing the wellbore within the first portion comprises: hydraulically fracturing the first producing layer from the first point and the second point to producing a plurality of hydraulic fractures in the first producing layer.

A twenty ninth embodiment can include the method of the twenty eighth embodiment, wherein the plurality of hydraulic fractures in the first producing layer intersect between the first point and the second point.

In a thirtieth embodiment, a wellbore completion comprises: a borehole extending into a subterranean formation comprising a multi-layered formation, wherein the multi-layered reservoir comprises a plurality of producing layers and at least one non-producing layer disposed between two or more producing layers or the plurality of producing layers; a first portion of the borehole disposed through the multi-layered formation, wherein the first portion maintains a high dog-leg severity throughout the first portion, and wherein the first portion passes through the plurality of producing layers; and one or more completions within the first portion of the wellbore, wherein the one or more completions are configured to allow for fluid communication between an interior of the borehole and the subterranean formation in at least one producing layer of the plurality of producing layers.

A thirty first embodiment can include the wellbore completion of the thirtieth embodiment, wherein the high dog-leg severity has an angle of between about 8 and about 16 degrees per 100 feet of wellbore length.

A thirty second embodiment can include the wellbore completion of the thirtieth or thirty first embodiment, further comprising: casing disposed within the borehole within the first portion; and one or more perforations disposed in the casing within the first portion.

A thirty third embodiment can include the wellbore completion of any of the thirtieth to thirty second embodiments, wherein the wellbore passes through a first producing layer of the plurality of producing layers at a first point and a second point.

A thirty fourth embodiment can include the wellbore completion of the thirty third embodiment, further comprising: hydraulic fractures in the first producing layer extending from the first point and the second point.

A thirty fifth embodiment can include the wellbore completion of the thirty fourth embodiment, wherein the plurality of hydraulic fractures in the first producing layer intersect between the first point and the second point.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method for forming a wellbore, the method comprising:

drilling the wellbore into at least one production zone in a subterranean formation;

maintaining a high dog-leg severity within an entire first portion of the wellbore, wherein the first portion is in the at least one production zone, and wherein the high dog-leg severity has an angle of at least about 8 degrees per 100 feet of borehole length; and completing the wellbore within the first portion.

2. The method of claim 1, wherein a first end of the first portion of the wellbore begins at an entrance point of the wellbore into the at least one production zone, and wherein a second end of the first portion of the wellbore has a vertical angle of less than 90 degrees with respect to a vertical angle of the first end of the first portion of the wellbore.

3. The method of claim 1, wherein the high dog-leg severity has an angle of between about 8 and about 22 degrees per 100 feet of wellbore length.

4. The method of claim 1, wherein completing the wellbore within the first portion comprises:

setting casing within the first portion; and perforating the casing within the first portion.

5. The method of claim 1, wherein completing the wellbore within the first portion comprises:

hydraulically fracturing the subterranean formation within the at least one production zone from within the first portion.

6. The method of claim 5, further comprising:

forming fractures in the subterranean formation both vertically and horizontally in response to hydraulically fracturing the subterranean formation within the at least one production zone from within the first portion.

7. The method of claim 6, wherein the fractures in the subterranean formation intersect between two or more fracturing points along a length of the wellbore.

8. The method of claim 1, wherein the first portion of the wellbore comprises a heel portion and a landing portion adjacent the heel portion, wherein the first portion of the wellbore further comprises a second heel portion adjacent the landing portion, and wherein the high dog-leg severity is substantially maintained through the heel portion, the landing portion, and the second heel portion.

9. The method of claim 1, further comprising:

forming localized fracturing around the wellbore in the first portion in response to drilling the wellbore while maintaining the high dog-leg severity within the first portion of the wellbore.

10. The method of claim 1, wherein the subterranean formation comprises a multi-layered reservoir, wherein the multi-layered reservoir comprises a plurality of producing layers and at least one non-producing layer disposed between two or more producing layers of the plurality of producing layers, wherein the first portion passes through the plurality of producing layers, and wherein the first portion of the wellbore is completed within at least one producing layer of the plurality of producing layers.

11. The method of claim 10, wherein the wellbore passes through a first producing layer of the plurality of producing layers at a first point and a second point, and wherein completing the wellbore within the first portion comprises:

hydraulically fracturing the first producing layer from the first point and the second point to producing a plurality of hydraulic fractures in the first producing layer.

12. The method of claim 11, wherein the plurality of hydraulic fractures in the first producing layer intersect between the first point and the second point.

13. The method of claim 1, wherein the high dog-leg severity has an angle of between about 8 and about 16 degrees per 100 feet of wellbore length.

14. A wellbore completion comprising:

a borehole extending into a subterranean formation;

a first portion of the borehole disposed within at least one production zone of the subterranean formation, wherein the first portion maintains a high dog-leg severity throughout the first portion, and wherein the high dog-leg severity has an angle of between about 8 and about 22 degrees per 100 feet of borehole length; and one or more completion zones within the first portion of the wellbore, wherein the one or more completion zones are configured to allow for fluid communication between an interior of the borehole and the subterranean formation.

15. The wellbore completion of claim 14, wherein a first end of the first portion of the wellbore begins at an entrance point of the wellbore into the at least one production zone, and wherein a second end of the first portion of the wellbore has a vertical angle of less than 90 degrees with respect to a vertical angle of the first end of the first portion of the wellbore.

16. The wellbore completion of claim 14, further comprising:

near wellbore fractures surrounding the wellbore adjacent the first portion.

17. The wellbore completion of claim 14, further comprising:

casing disposed within the borehole within the first portion; and one or more perforations disposed in the casing within the first portion.

18. The wellbore completion of claim 17, further comprising:

hydraulic fractures within the subterranean formation extending from the one or more perforations.

19. The wellbore completion of claim 18, wherein the one or more perforations comprise a plurality of perforations, and wherein the hydraulic fractures intersect between at least two of the plurality of perforations.

20. The wellbore completion of claim 14, wherein the first portion of the borehole comprises a heel portion and a landing portion adjacent the heel portion, wherein the first portion of the wellbore further comprises a second heel portion adjacent the landing portion, and wherein the high dog-leg severity is substantially maintained through the heel portion, the landing portion, and the second heel portion.

21. The wellbore completion of claim 14, wherein the subterranean formation comprising a multi-layered formation, wherein the multi-layered reservoir comprises a plurality of producing layers and at least one non-producing layer disposed between two or more producing layers or the plurality of producing layers;

wherein the first portion of the borehole is disposed through the multi-layered formation, and wherein the first portion passes through the plurality of producing layers; and wherein the one or more completions are configured to allow for fluid communication between the interior of the borehole and the subterranean formation in at least one producing layer of the plurality of producing layers.

22. The wellbore completion of claim 21, wherein the borehole passes through a first producing layer of the plurality of producing layers at a first point and a second point, and wherein the wellbore completion further comprises: hydraulic fractures in the first producing layer extending from the first point and the second point.

23. The wellbore completion of claim 22, wherein the plurality of hydraulic fractures in the first producing layer intersect between the first point and the second point.

* * * * *